United States Patent [19]

Brandenburg

[11] Patent Number: 4,739,572

[45] Date of Patent: Apr. 26, 1988

[54] METHOD AND APPARATUS FOR ORIENTING AND LOADING RIM-FIRE CARTRIDGES

[75] Inventor: Ernest Brandenburg, Dallas, Tex.

[73] Assignee: Ram-Line, Inc., Golden, Colo.

[21] Appl. No.: 902,888

[22] Filed: Sep. 2, 1986

[51] Int. Cl.[4] ..... F42B 39/06

[52] U.S. Cl. ..... 42/87

[58] Field of Search ..... 42/87, 88

[56] References Cited

U.S. PATENT DOCUMENTS

| | | | |
|---|---|---|---|
| 2,451,521 | 10/1948 | Uglum | 42/87 |
| 2,466,936 | 4/1949 | Dowie et al. | 198/33 |
| 2,783,570 | 3/1957 | Kunz | 42/87 |
| 2,849,980 | 9/1958 | Collins et al. | 118/69 |
| 3,292,293 | 12/1966 | Chiasera et al. | 42/87 |
| 3,628,273 | 12/1971 | Lach | 42/87 |
| 4,392,321 | 7/1983 | Bosworth | 42/87 |
| 4,566,212 | 1/1986 | Chestnut | 42/50 |
| 4,574,511 | 3/1986 | Csongor | 42/87 |

*Primary Examiner*—Charles T. Jordan

*Attorney, Agent, or Firm*—Sheridan, Ross & McIntosh

[57] ABSTRACT

A method and an apparatus for orienting and loading a plurality of unoriented rim-fire cartridges into a magazine are provided. An orienter apparatus employs gravity to orient rim-fire cartridges by hanging a plurality of cartridges from a number of parallel rails. The orienter is repositioned to a second or vertical configuration so that gravity can be used to feed the columns of oriented cartridges through a chute. The orienter operatively engages with a loader which employs a camming mechanism to move cartridges one at a time into a magazine. The cartridges are placed in a first angular relationship with respect to the magazine opening and are moved through the opening while changing the angular relationship of the cartridge with the magazine opening.

33 Claims, 5 Drawing Sheets

METHOD AND APPARATUS FOR ORIENTING AND LOADING RIM-FIRE CARTRIDGES

FIELD OF THE INVENTION

The present invention relates to a method and an apparatus for loading cartridges into a magazine and, in particular, to a method and apparatus for orienting a plurality of unoriented rim-fire cartridges and loading the oriented cartridges into a magazine.

BACKGROUND INFORMATION

A number of types of firearms can be used in conjunction with magazines for holding cartridges to assist in feeding the cartridges into the firearm. When the magazines are designed to be reusable, the depleted magazines must be reloaded with cartridges. Many reusable magazines can be reloaded by hand without the use of any apparatus. However, hand reloading is often slow and tedious so that is is useful to provide an apparatus for assisting in the reloading process. A number of characteristics of cartridges and magazines present problems which a useful reloading apparatus must solve.

Cartridges are produced in a variety of configurations including center-fire cartridges which are typically in the shape of a cylinder with a rounded or pointed end and rim-fire cartridges, i.e. cartridges which have a generally cylindrical body portion but also have a rim of a larger diameter than the body diameter. Rim-fire cartridges are somewhat more difficult to store, handle, and load because the cartridges do not stack in a regular or linear fashion as center-fire cartridges do. Thus, devices for assisting in loading cartridges into magazines preferably should be able to accommodate a variety of cartridge shapes and, particularly, should be capable of accommodating rim-fire cartridges.

Cartridges are often sold packaged in an unoriented manner, i.e. in which the longitudinal axes of the cartridges are not substantially parallel or coplanar with each other. Because a cartridge magazine requires that the cartridges be positioned in an oriented fashion, a useful apparatus for loading should both provide for orienting the cartridges and then placing the oriented cartridges into the magazine.

Certain magazines require that cartridges be positioned into the magazine in a particular manner. Specifically, magazines for use with rim-fire cartridges often require that the cartridges be (1) inserted into the magazine one-at-a-time, i.e. such that the cartridge which is being inserted into the magazine moves in a direction or at an angle different from the direction or angle of subsequent cartridges which are to be placed into the magazine and/or (2) that the cartridges be positioned into the magazine by first placing the cartridge at a first angle with respect to the magazine opening and then moving or pushing the cartridge while changing the angle to a second angle with respect to the magazine opening. A useful loading apparatus thus should be capable of a configuration which will result in a one-at-a-time and/or multiple angle insertion or cartridge.

The oriented cartridges supplied to the loader apparatus should be in a column of sufficient number that the loading into magazines can be performed efficiently without unnecessary interruptions. However, a device for holding a single column of a large number of cartridges results in an awkward and unwieldy apparatus. Thus, it is useful to provide a cartridge orienting and loading method and apparatus which supplies a column of cartridges in a large number but without being of cumbersome dimensions.

Because a loading mechanism may be used in field or outdoor conditions, devices which depend upon springs or motors are subject to freezing from exposure to cold and/or corrosion or deterioration from exposure to water and the like. Thus, it is advantageous to provide a device which orients cartridges and can be used for loading cartridges but which does not require a motor or springs to orient or move the cartridges.

SUMMARY OF THE INVENTION

The present invention relates to a method and apparatus for orienting a plurality of unoriented cartridges and loading the oriented cartridges into a magazine. The apparatus can be provided in an integral configuration, but is preferably formed of two detachable portions, an orienting portion and a loading portion. The orienting portion is designed to use gravity to orient a plurality of unoriented rim-fire cartridges using a number of rails. The rails are spaced apart farther than the body diameter of the cartridges but less than the rim diameter. In this manner, when cartridges are placed adjacent to the rails, the nose-portion of the cartridges, being heavier than the rim-end, will tilt or move downward between the rails. The cartridges will thus be hung from the rails by portions of their rims with the heavy nose-portion of the cartridges pointing down. In this configuration, the cartridges will be substantially parallel with each other, i.e. with the longitudinal axes of the cartridges all substantially parallel with each other. This orienting of the cartridges may require that the orienting device be shaken. The device preferably contains more than two rails, preferably in substantially parallel configuration so that the bullets are oriented into a number of columns.

After the cartridges are oriented, the orienting portion is up-ended or moved to a second position so that the oriented cartridges move in a direction perpendicular to their longitudinal axes to form one or more columns of adjacent cartridges. The force of gravity is then used to move the cartridges down a chute towards an opening in the orienting portion. When two or more columns of cartridges are provided, a gate is used to direct each column, in turn, towards the chute. The opening at the bottom of the chute is controlled using a latch mechanism to prevent the cartridges from leaving the orienting portion prematurely.

The orienting portion is then connected to the loading portion which contains an area for receiving the orienting portion. A latch-activating cam on the loading portion opens the latch so that a first cartridge falls, under the force of gravity, into a cartridge receiving device on the loading portion. An empty or partly empty magazine is inserted in a magazine receiving area of the loading portion. The magazine receiving area is configured to hold the opening of the magazine in a predetermined position with respect to the cartridge receiving device.

The cartridge receiving device is movable and is attached to a mechanism such as a cam mechanism which controls the movement of the cartridge receiving device. The camming mechanism for moving the cartridge receiving device is configured to move the cartridge through the opening of the magazine and into the magazine in a manner which is consistent with the loading requirements of the particular magazine. For rimfire cartridges, the cartridge is initially guided by movement of the cartridge rim through a rim receiving slot. The cartridge is placed in a first angular relationship with respect to the magazine opening and the rim portion is inserted through the opening. The cartridge is then moved to change the angular relationship to a second angle with respect to the magazine opening as the remainder of the cartridge is inserted through the magazine opening and into the magazine. The camming mechanism is then returned to its original position to permit the next cartridge to enter the cartridge receiving device. In this manner, the cartridges are loaded into the magazine one at a time.

As can be appreciated, the present invention provides a number of advantages. The invention is able to accommodate rim-fire cartridges to assist in orienting and loading such cartridges. The invention permits orienting cartridges which are packaged in an unoriented fashion. The invention is compatible with the requirements of a number of magazine loading techniques including one-at-a-time loading and loading by changing the angle of the cartridge as it is inserted. By providing for a loader which is detachable from the orienter, the loader can be fixed for one-handed operation while the orienter can be placed in a first position for orienting and up-ended for engagement with the loader. A loaded magazine can be removed and an empty magazine can be attached to the loader without separating the loader from its support. The orienting and movement of the cartridges through the chute is entirely gravity-powered and does not require use of a motor or springs. By providing a gate for controlling movement of cartridges, the benefits of providing a larger number of cartridges in columnar form are provided without the cumbersome dimensions required by a single column device.

DETAILED DESCRIPTION OF THE PREFERRED EMBODIMENT

Figure 1:
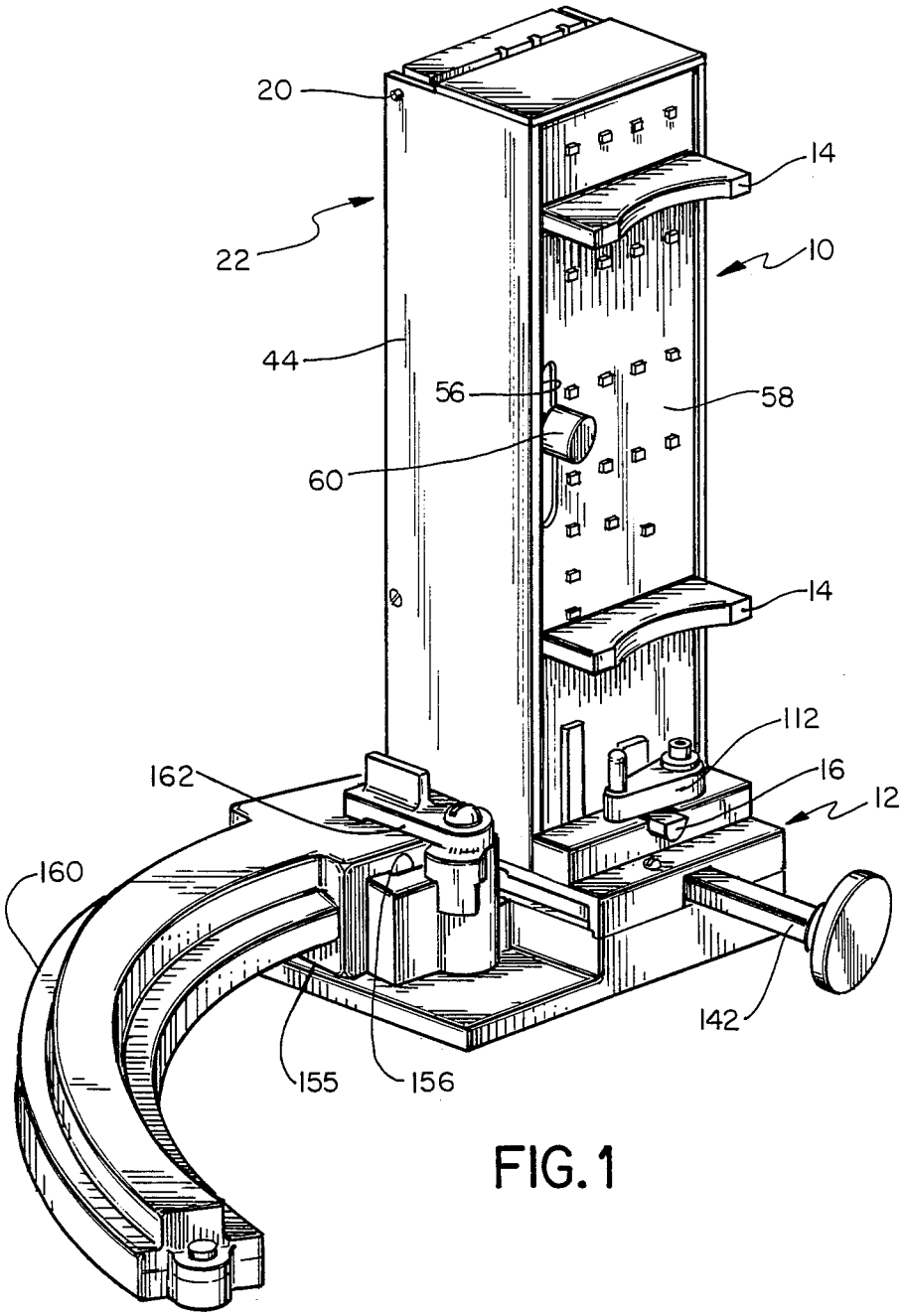
FIG. 1 is a perspective view of the loader portion engaged with the orienter portion and with a magazine positioned in the magazine receiving area.

The present invention relates to a method and an apparatus for orienting a plurality of unoriented cartridges and loading the cartridges into a magazine. Although the orienter and loader can be provided as an integral device, in the preferred embodiment, as best seen in FIG. 1, the orienter 10 is detachably engaged with the loader 12.

Figure 2:
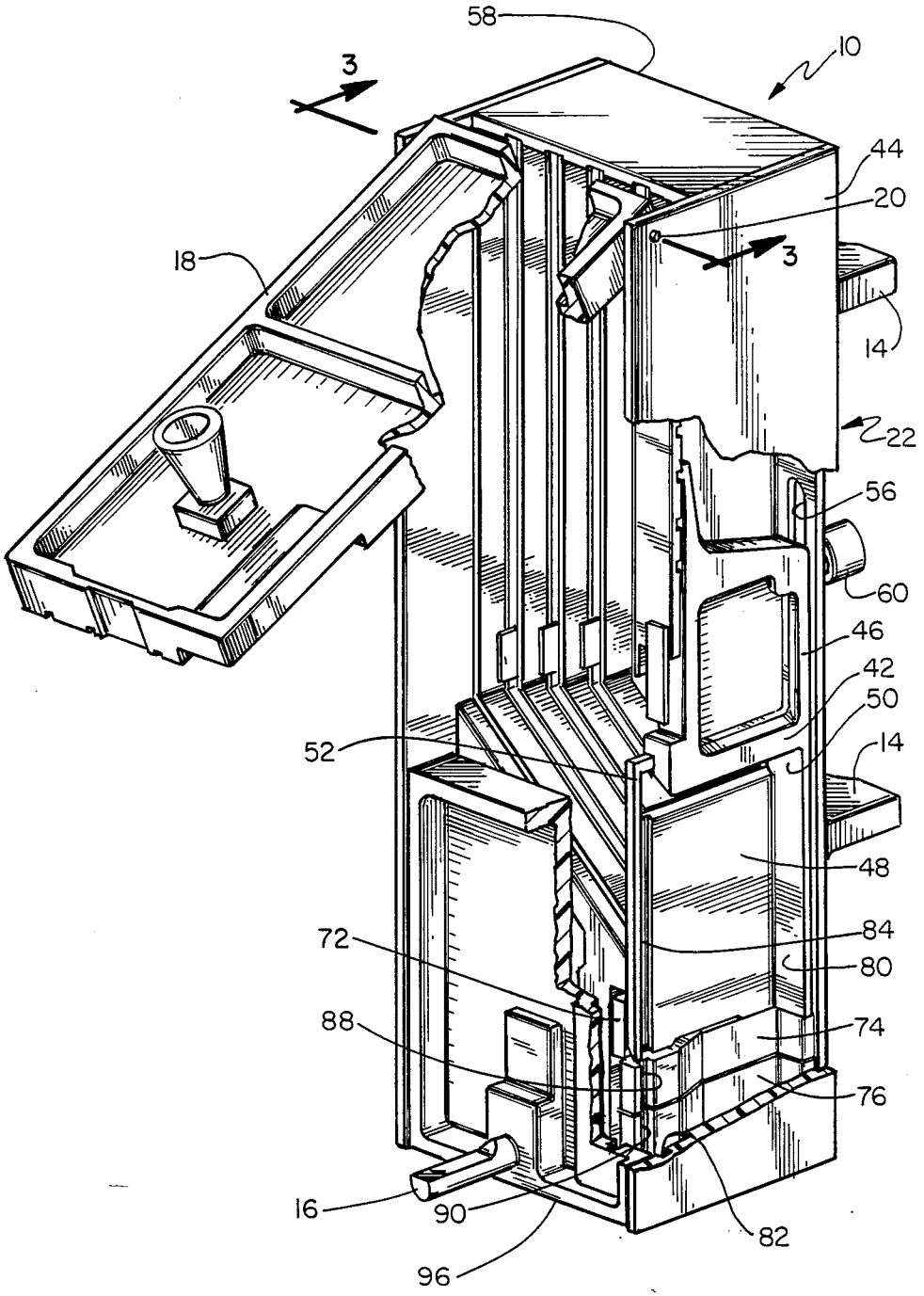
FIG. 2 is a perspective view of the orienter portion with the door in an opened position and with a portion of one side wall cut away and with the gate opening aligned with the second space.

Referring now to FIG. 2, the orienter 10 is depicted in the form of a box or rectangular parallelepiped. Projecting outward of one wall of the orienter 10 are two feet 14. Posts 16 project outward of two opposite faces of the orienter for holding the orienter 10 adjacent the loader 12 as described below. A door 18 is provided on one face of the orienter 10 attached by hinges 20 to provide access to the interior of the orienter 10. The upper portion 22 of the orienter 10 contains a plurality of rails with upper portions 24A, 26A, 28A, 30A, 32A which are parallel to a wall of the orienter 10 and lower portions 24B, 26B, 28B, 30B, 32B which are angled with respect to the upper portion. The rails are substantially parallel and spaced apart. The distance which the rails are spaced apart relates to the dimensions of the cartridges with which the orienter 10 is intended to be used. The spacing between the rails is greater than the diameter of the cartridge body portion but less than the diameter of the cartridge rim. In this way, the rails define a number of slot-shaped spaces 34, 36, 38, 40.

Figure 3:
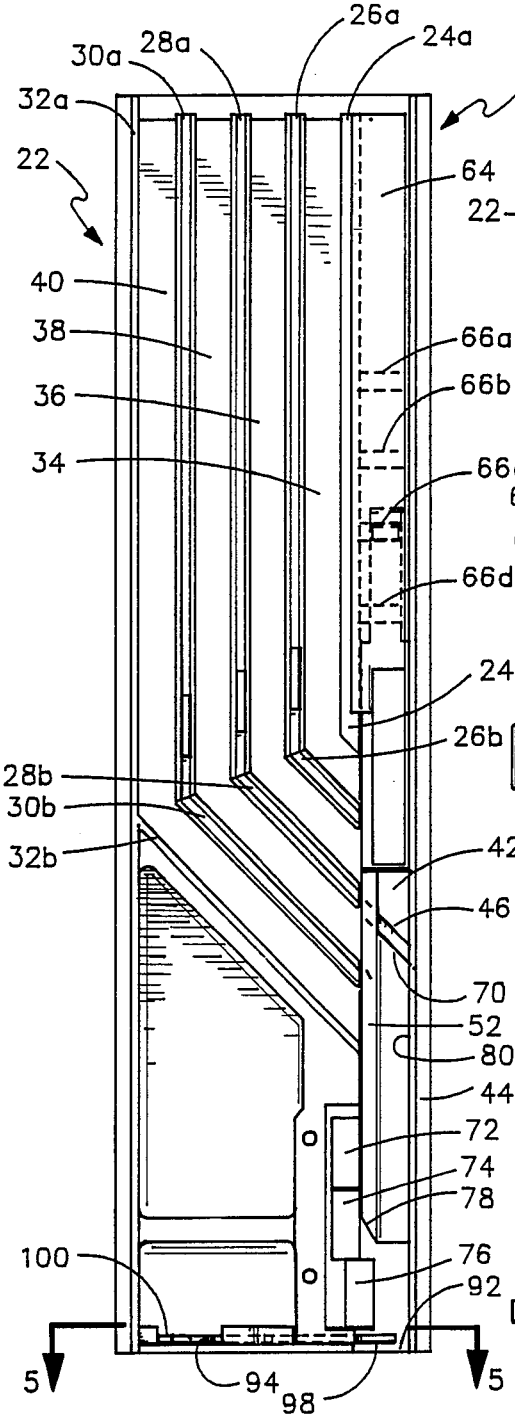
FIG. 3 is a cross-sectional view taken along line 3—3 of FIG. 2 but with the gate opening aligned with the third space.
Figure 4:
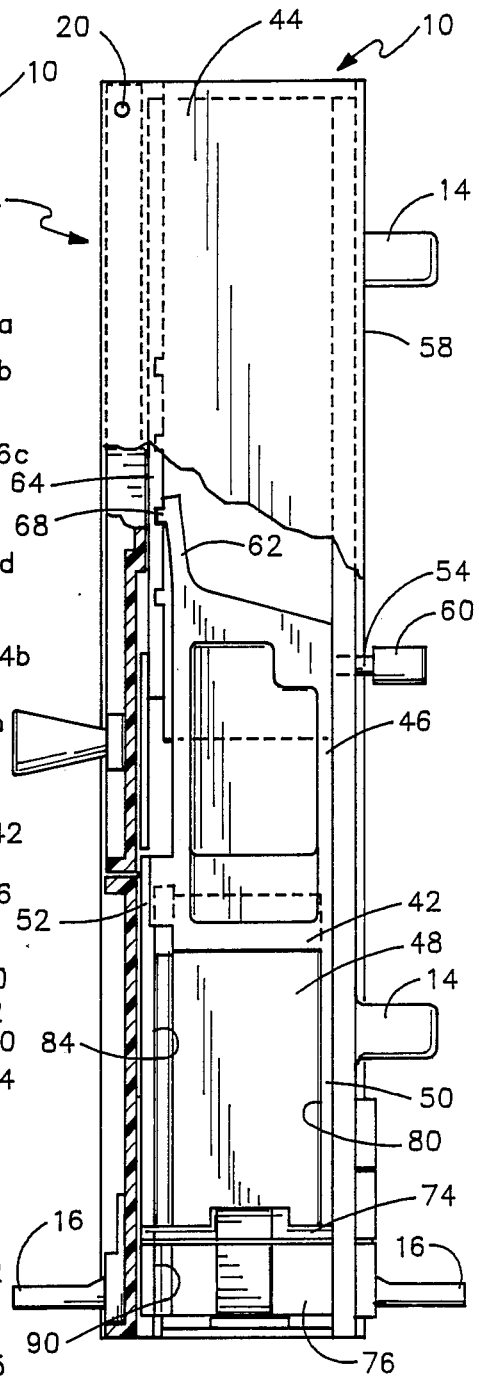
FIG. 4 is a side elevational view of the orienter portion with a part of the side wall broken away.

A gate 42 is slidably mounted adjacent to a first wall 44 of the orienter 10. The gate 42 includes an upper portion 46 and a lower portion 48 attached so as to slide together using an extension 50 integrally formed with an edge of the lower portion 48 and an arm 52 extending from the upper portion 46 to the lower portion 48. As seen in FIG. 4, a rod 54 extends outward from the gate 42 through a slot 56 formed in a second side wall 58. A handle 60 is attached to the rod 54 for controlling movement of the gate 42. An arm 62 extends upward from the gate 42 and resiliently presses against a control surface 64. The arm 62 and control surface 64 interact to releasably hold the gate 42 in one of a number of preferred positions. As depicted in FIG. 3, the interaction of the arm 62 and control surface 64 is accomplished by providing the control surface 64 with a number of depressions or notches 66A, 66B, 66C, 66D and providing a protrusion such as an integrally molded detent 68 attached to the arm 62. When the gate 42 is positioned such that the protrusion 68 aligns with one of the notches 66, the gate 42 is releasably held in such position.

The upper portion 46 is spaced from the lower portion 48 to define a space 70 between the upper portion 46 and the lower portion 48. The size of the gate space 70 corresponds to the distance between the rails 24, 26, 28, 30, 32. The notches 66 are positioned such that when the detent 68 is aligned with one of the notches 66A-D, the space 70 is aligned with the lowermost portion of the slots 34, 36, 38, 40 respectively. Spacers 72, 74, 76 are resiliently mounted opposite to and spaced from the lower portion of the first wall 44. The lower edge 78 of the lower portion of the gate 42 is angled so that as the gate 42 is moved downward, the lower edge 78 of the gate 42 forces the spacers 72, 74, 76, in turn, in a direction away from the first wall 44. The spacers 72, 74, 76 are dimensioned so that when the gate space 70 is aligned with any of the slots 34, 36, 38, except the lowermost slot 40, a surface of one or more of the spacers 72, 74, 76 will be aligned with the surface of the lower portion 48. In this way, the spacers 72, 74, 76 cooperate with the gate 48 and the first wall 44 to define a chute 80 having a variable dimension, depending upon the position of the gate 42. The chute 80 is provided with rim guides in the form of slots. One slot 82 is formed in the first wall 44. Another slot 84 is formed in the lower gate 48 and is positioned to align with slots 86, 88, 90 formed in the spacers 72, 74, 76 respectively.

The dimensions of the slots 34, 36, 38, 40, gate space 70, notches 66, chute 80 and gate 42 are coordinated to provide for control of movement of cartridges from the slots 34, 36, 38, 40 into the chute 80. Specifically, when the detent 68 is aligned with a slot 66, the gate space 70 provides communication between one of the slots 34, 36, 38, 40 and the chute 80. At the same time, the upper portion of the gate 46 and the lower gate portion 48 prevent communication between the chute 80 and any of the slots 34, 36, 38, 40 other than that slot which is in communication with the chute 80.

Figure 5:
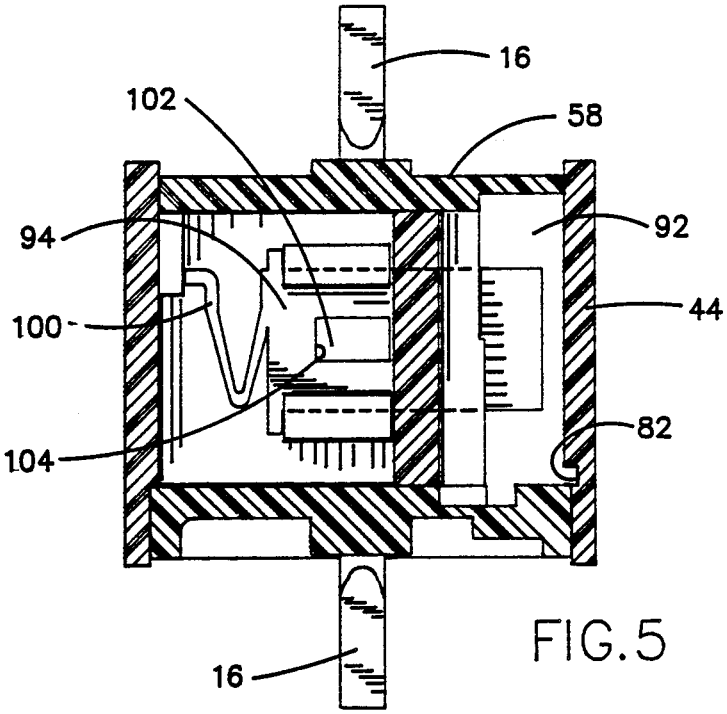
FIG. 5 is a bottom plan view of the orienter portion showing portions of the latch in phantom lines with the gate opening aligned with the fourth space.

An opening 92 is provided in the lower portion of the chute 80 to allow removal of cartridges from the orienter 10. As best seen in FIG. 5, latch 94 is provided on the bottom surface 96 of the orienter 10. Extending from the latch 94 is a tongue 98 extending at least partially across the opening 92 to close the opening 92 so as to prevent removal of cartridges through the opening 92 until the tongue 98 is moved. The latch 94 is slidably mounted against the bottom surface 96 and provided with a spring 100 for urging the tongue 98 towards the first wall 44 so as to cover the opening 92. The spring 100 can be any type of spring but is preferably an integrally moulded leaf spring. The latch 94 is provided with an opening 102, an edge 104 of which interacts with a cam on the loader 12 to move the latch 94 in a manner described below.

Figure 8:
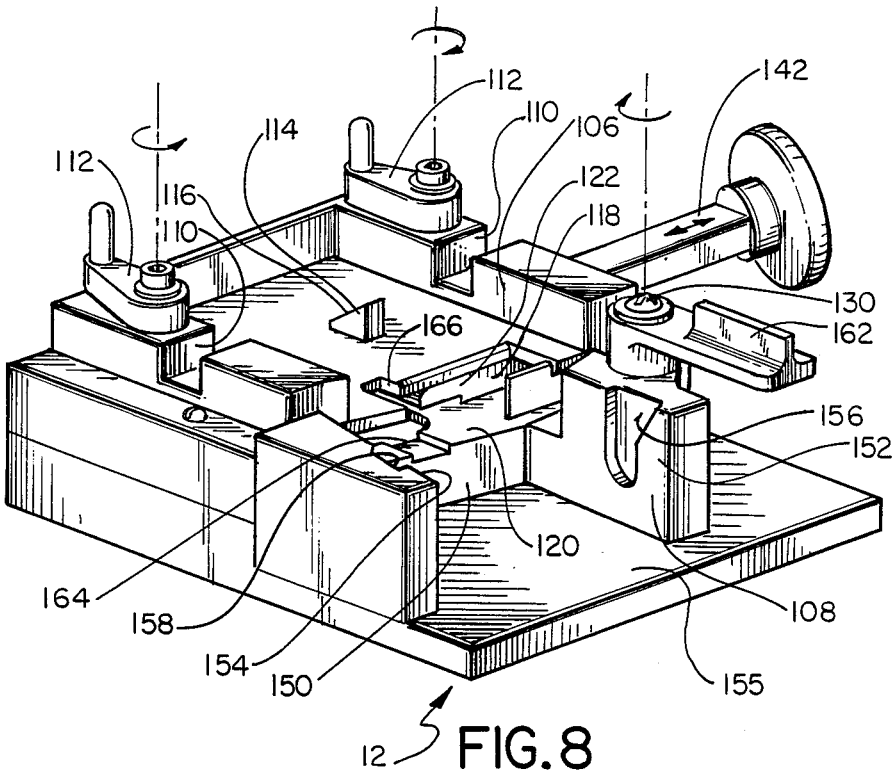
FIG. 8 is a perspective view of the loader base portion.

Referring now to FIG. 8, the loader 12 is provided with a orienter receiving area 106 and a magazine receiving area 108. The orienter receiving area 106 has a configuration substantially corresponding to the size and shape of the bottom surface 96 of the orienter 10. Slots 110 are provided for receiving the posts 16. Latches 112 are rotatably mounted adjacent to the slots 110 to hold the posts 16 in the slots 110 in the manner depicted in FIG. 1. A cam 114 is positioned in the orienter receiving area 106 and provided with a slanting camming surface 116. The cam 114 is positioned such that when the orienter 10 is placed into the orienter receiving area 106 and the posts 16 are registered in the slots 110, the upper surface 116 of the cam 114 engages with the edge 104 of the opening 102 in the latch 94 to move the latch 94 against the urging of the spring 100. This movement of the latch 94 results in the tongue 98 being withdrawn from the opening 92. When the orienter 10 is in the orienter receiving area 106 in the position described, the opening 92 of the chute 80 will lie directly above the cartridge receiving area 118.

Figure 6:
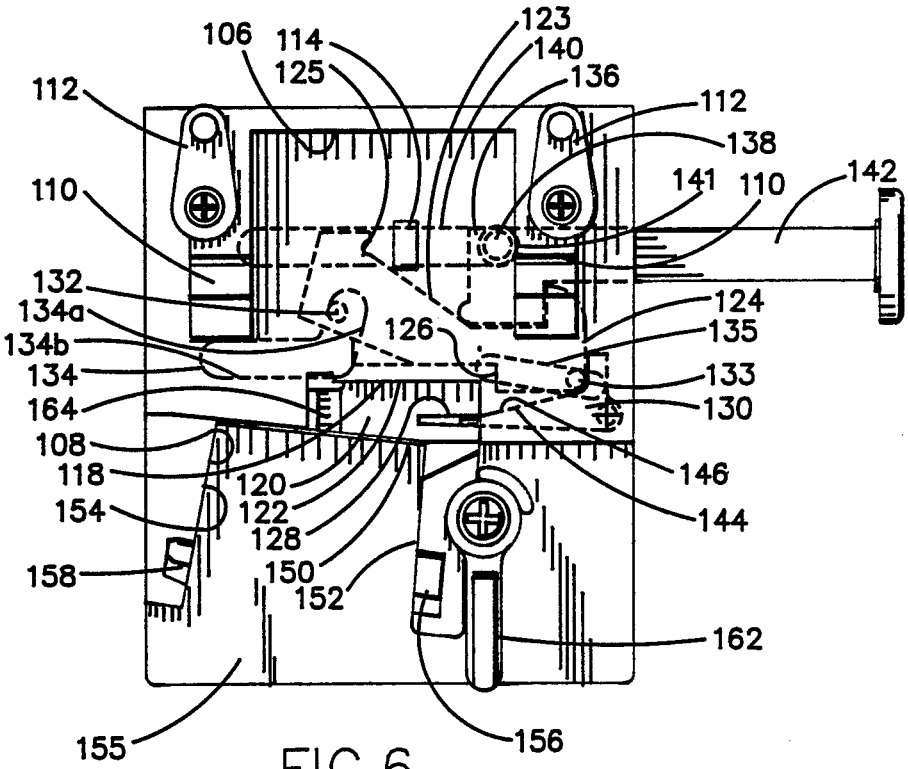
FIG. 6 is a top plan view of the loader base portion showing the cam and cam followers in phantom lines.
Figure 7:
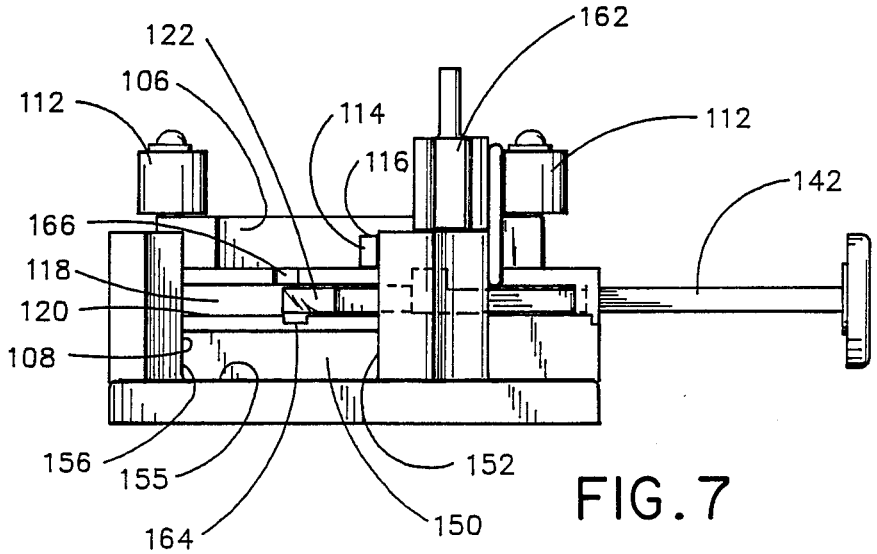
FIG. 7 is a front elevational view of the loader base portion showing parts of the cartridge receiver in phantom lines.

With reference also to FIGS. 6 and 7, the cartridge receiving area 118 is defined by a lower surface 120, first and second cartridge contact surfaces 122, 126 of a first cam follower 124 and a first cartridge contact surface 128 of a second cam follower 130.

The first cam follower 124 and the second cam follower 130 are mounted underneath the orienter receiving area 106. The first cam follower 124 is provided with first and second protrusions 132, 133 extending downward through first and second slots 134, 135. The movement of the first cam follower 124 is thus in part guided by the protrusions 134, 135 bearing against edges of the slots 134, 135. The moving cam 136 is also provided with a protrusion 138 constrained to move within a slot 140. The moving cam 136 is attached to a rod or plunger 142 for moving the moving cam 136.

The second cam follower 130 has an angled surface 144 adjacent to a surface 146 of the first cam follower 124. The surface 146 of the first cam follower 124 itself acts as a cam for the second cam follower 130.

A spring 141 is provided to urge the moving cam 136 towards the position depicted in FIG. 6 in which both cam followers 124, 130 are positioned farthest from the magazine receiving area 108.

The magazine receiving area 108 is defined by a back wall 150, side walls 152, 154, and a bottom surface 155. The side walls 152, 154 contain grooves 156, 158 for receiving protrusions (not shown) on a magazine 160 to hold the magazine 160 properly registered in the magazine receiving area 108. A latch 162 is rotatably mounted adjacent to the magazine receiving area 108 and positioned such that the latch 162 can be rotated to hold the magazine 160 in the magazine receiving area 108 in the desired position. A groove 164 is formed in the bottom surface 120 of the cartridge receiving area 118 leading from the cartridge receiving area 118 to the magazine receiving area 108. A slot 166 is formed in the orienter receiving area 106 leading to the cartridge receiving area 118. The groove 164 and slot 166 cooperate to accommodate the rim of a cartridge and to guide movement of the cartridge during the loading.

Operation of the preferred embodiment of this invention will now be described. The orienter 10 is detached from the loader 12 and placed in a horizontal position, i.e. supported by the feet 14 with the door 18 facing upwards. The door 18 is opened and a plurality of unoriented rim-fire cartridges are placed within the orienter 10 adjacent to the rails 24, 26, 28, 30, 32. The orienter 10 is agitated by shaking or vibrating while maintaining the orienter 10 in a substantially, though not necessarily strictly, horizontal position. Because the nose-portions of rimfire cartridges are substantially heavier than the rimportion of rim-fire cartridges, as the orienter 10 is agitated, the nose-portions of the cartridges will fall or swing downward between the rails 24, 26, 28, 30, 32. Since the spaces 34, 36, 38, 40 are larger than the body diameters but less than the rim diameters, the cartridges will be hung by their rim-portions from the rails with the nose-portions pointing downward. By this means, the unoriented cartridges are placed in an oriented position, i.e. with the longitudinal axes of the cartridges being substantially parallel and the nose-portion of the cartridges pointing downward.

The door 18 of the orienter 10 is then closed and the orienter 10 is up-ended to a position in which the bottom surface 96 of the orienter 10 is facing downward and the first and second side walls 44, 58 are in a substantially vertical position. In this orientation, the rails 24, 26, 28, 30, 32 will be in a substantially vertical position. The force of gravity will cause the cartridges to slide through the spaces 34, 36, 38, 40 in a direction substantially perpendicular to the longitudinal axes of the cartridges so that the cartridges will lie adjacent to each other in the lower portions of the spaces 34, 36, 38, 40. The cartridges will thus be positioned in a plurality of stacks or columns lying in the spaces 34, 36, 38, 40. By a stack or column of cartridges is meant that the longitudinal axis of any particular cartridge in a column or stack is substantially, but not necessarily precisely, parallel to the longitudinal axis of a neighboring cartridge in the same column or stack. Because the rim diameters are larger than the body diameters, the cartridges in a column will not be as nearly parallel as was the case when the orienter 10 was in a horizontal position. Because the upper and lower portions of the rails 24, 26, 28, 30, 32 meet at an angle, the longitudinal axes of cartridges in a particular column will not be coplanar.

The handle 60 of the gate 42 is moved to slide the gate to a position in which the detent 68 is aligned with one of the notches 66A, 66B, 66C, 66D. For purposes of example, the operation of the invention will be described with reference to a configuration when the detent 68 is aligned with the third notch 66C, as depicted in FIG. 3. In this configuration, the gate space 70 is aligned with the lowermost portion of the third space 38. Under the influence of gravity, the column of cartridges in space 38 will move through the gate space 70 and into the chute 80. Movement of the cartridges through the chute 80 will be partially controlled by the cartridge rims moving through the grooves 82, 84, 90. The lowermost of the cartridges in the chute 80 will abut against the tongue 98 of the latch 94 to prevent any cartridges exiting from the orienter 10.

The orienter 10 is engaged with the loader 12 by positioning into the orienter receiving area 106 with the posts 16 residing in the slots 110 and latched therein by latches 112, as depicted in FIG. 1. In this position, the upper surface 116 of the fixed cam 114 will move the latch 94 against the urging of the spring 100 to withdraw the tongue 98 from the chute opening 92. The lowermost cartridge in the chute 80 will then fall by the force of gravity into the cartridge receiving area 118. An empty or partially empty magazine 160 is placed into the magazine receiving area 108 by sliding protrusions on the magazine 160 through the grooves 156, 158, positioning one surface of the magazine 160 against the bottom surface 155 of the magazine receiving area 108 and rotating latch 162 to hold the magazine 160 in the magazine receiving area 108. In this position, the opening (not shown) of the magazine 160 is positioned adjacent to the cartridge receiving area 118.

Plunger 142 is pushed towards the orienter receiving area causing the moving cam 136 to move in a linear fashion. As the moving cam 136 bears against the first follower surface 123 of the first cam follower 124, the first cam follower 124 moves, guided by movement of the first and second protrusions 133, 135 through the first leg 134A of the slot 134 and through slot 135, respectively. Movement of the camming surface 146 of the first cam follower causes movement of the second cam follower 130 substantially parallel to the movement of the first cam follower 124. Because the first cartridge contact surface 122 of the first cam follower 124 and the first cartridge contact surface 128 of the second cam follower 130 bear against the cartridge during this pivoting movement, the cartridge is pivoted to move the cartridge rim through the slot 166 and the groove 164. Continued movement of the plunger 142 causes continued movement of the first and second cam followers 124, 130 and consequent movement of the cartridge lying in the movable cartridge receiving area 118 until the movable cam 136 reaches the cut-out portion 125 of the first cam follower 124 and the first protrusion 132 simultaneously reaches the second leg 134B of the slot 134. At this position, the cartridge receiving area 118 has rotated to an extent that the rim portion of the cartridge lying therein has moved partially through the opening of the magazine 160 and lies in a first angular relationship with respect to the opening of the magazine 160.

As the plunger 142 is further pushed, the protrusion 132 of the first cam follower 124 moves through the second leg 134B of the slot 134 and the second protrusion 133 of the first cam follower 124 moves through the second slot 135. Because the second slot 135 is angled with respect to the orientation of the second leg 134B of the first slot 134, the cartridge receiving area will continue to move towards the opening of the magazine 160 while the angular relationship of the cartridge with respect to the opening is changed. The second cartridge contact surface 126 bears against the nose-portion of the cartridge to push the cartridge completely through the opening of the magazine 160 while the angular relationship is being changed.

The plunger 142 is now released and a spring 142 causes the plunger 142, first cam follower 124, and second cam follower 130 to return to the original position depicted in FIG. 6. In this configuration, the lowermost cartridge in the orienter 10 is free to fall, under the force of gravity, into the cartridge receiving area 118. A second activation of the plunger 142 will position the second cartridge into the magazine 160 in the same manner as described with regard to the first cartridge. Continued use of the plunger 142 will result in loading cartridges into the magazine 160 until either the magazine 160 is full or there are no more cartridges in the chute 80. When the chute 80 is depleted of cartridges, the handle 60 is manipulated to move the gate 42 so as to align the gate space 70 with another of the spaces 34, 36, 40 so as to allow another plurality of cartridges into the chute 80 for loading into the magazine 160.

As an example, the gate 42 can be moved from the position depicted in FIG. 3 to align the detent 68 with the second notch 66B as depicted in FIG. 2. As a result of this movement, the second spacer 74 relaxes to a position substantially aligned with the third spacer 76 to provide, in cooperation with the third spacer 76 and the lower gate portion 48, a substantially continuous wall for the chute 80 and a substantially continuous series of slots 84, 88, 90 for guidance of the rims, as depicted in FIG. 2. When the gate 42 is in this position, the upper portion 46 of the gate 42 prevents communication between the first slot 34 and the chute 80 while the lower gate portion 48 prevents communication of the third and fourth slots 38, 40 with the chute 80.

When all cartridges in the orienter 10 have been loaded into magazines, the orienter 10 is removed and either replaced with a new orienter containing oriented cartridges or is itself reused to orient a second plurality of cartridges.

When the magazine 160 has been fully loaded, it is removed by rotating the latch 162 and sliding the magazine protrusions (not shown) through the slots 166. The full magazine can then be replaced by an empty or partially empty magazine for further loading.

As will be apparent to those skilled in the art, although not depicted in the figures, a number of variations on the preferred embodiment can be used. The number of slots and rails can be varied. Communication from the columns to the chute can be controlled in a number of ways including a plurality of individually opened gates, or a gate placed in another position such as the region in which the upper rail portions 24–32A meet the lower rail portions 24–32B. Spacers 72, 74, 76 can be positioned in additional or alternative positions, such as the region in which the upper rail portions 24–32A meet the lower rail portions 24–32B, to assist in guiding cartridge movement.

A number of features which are described as being manually activated can be automatically activated and a number of automatic features can be manually activated. For example, the automatic cam-action opening of the latch and tongue can be accomplished manually. The spring-return of the plunger to its original position can be accomplished manually. The manual selection of gate positions can be accomplished automatically by electronics, levers or other well-known means.

A number of features described as being internally mounted can also be externally mounted, such as the detent 66 and notch 68 gate controller, or the spacers 72, 74, 76.

Movement of cartridges through the opening 92 can be controlled by devices other than the latch 94, such as providing a gate 42 which can prevent all entry of cartridges into the chute 80 until desired.

The particular camming mechanism 124, 130 described can be modified to provide a different movement of the cartridge into the magazine 160, such as by providing a different shape or number of cams, cam followers, posts or slots. The movement of the cartridges through the magazine opening, rather than being controlled by cams and slots, can be controlled by a number of other devices known in the art such as gear trains, stepping motors, electronic switches, and the like.

Although the preferred embodiment was described in relation to orienting and loading rim-fire cartridges, many aspects of the invention such as the described loading process and gating of columns to a chute can be usefully employed in connection with orienting and loading center-fire or rimless cartridges.

Lastly, it should be understood that the orienter of the present invention need not be used with the particular loader described herein, but could be adapted for use with other mechanisms. Similarly, the loader need not be used with the particular orienter described herein.

Although the present invention has been described with reference to certain embodiments, it should be appreciated that further modifications can be effected within the spirit and scope of the invention.

What is claimed is:

1. An apparatus for orienting a plurality of unoriented cartridges each having a longitudinal axis and for loading oriented cartridges into a magazine having an open end, comprising:

first means for orienting the plurality of cartridges substantially by means of the force of gravity wherein the longitudinal axes of the oriented cartridges are substantially parallel with each other; and second means for receiving said plurality of substantially parallel cartridges and loading said cartridges one at a time into the magazine using the force of gravity to move at least some of said cartridges toward the magazine, said second means including cartridge moving means for moving at least a first cartridge, said cartridge moving means moving in a first direction to move the first cartridge in said first direction towards the open end of the magazine and then moving in a second direction to move the first cartridge in said second direction into the open end of the magazine, wherein said cartridge moving means continuously contacts the first cartridge while moving in said first and second directions.

2. The apparatus as claimed in claim 1, wherein:

said first means is detachably engaged with said second means.

3. The apparatus as claimed in claim 2, wherein:

said second means includes receiving means for detachably engaging the magazine.

4. An apparatus for orienting a plurality of unoriented cartridges each having a longitudinal axis and for loading oriented cartridges into a magazine comprising:

first means for orienting the plurality of cartridges substantially by means of the force of gravity wherein the longitudinal axes of the oriented cartridges are substantially parallel with each other;

second means for receiving said plurality of substantially parallel cartridges and loading said cartridges into the magazine using the force of gravity to move at least some of said cartridges toward the magazine; and wherein at least one of said first means and said second means is in a first, horizontal position when the cartridges are being oriented and said one is in a second, vertical position when the cartridges are being loaded in the magazine.

5. The apparatus as claimed in claim 4, wherein:

said first means retains at least some of said cartridges in a substantially vertical stack when said one is in said second vertical position; and said second means comprises means for moving at least one of said cartridges in said vertical stack of cartridges in a substantially horizontal direction into the magazine.

6. An apparatus for loading a plurality of cartridges into a magazine having an open end, comprising:

first means for retaining said plurality of cartridges in a substantially parallel relationship; and second means for loading said cartridges into the magazine, said second means including cartridge moving means for moving a first cartridge, said cartridge moving means moving in a first direction to move the first cartridge in said first direction towards the open end of the magazine and then said cartridge moving means moving in a second direction to move the first cartridge into the open end of the magazine and wherein said cartridge moving means continuously contacts the first cartridge while moving in said first and second directions.

7. The apparatus as claimed in claim 6, wherein:

said cartridge guide means comprises at least one slot for receiving a cartridge rim portion.

8. An apparatus for orienting a plurality of unoriented rim-fire cartridges each having a longitudinal axis, a body diameter and a rim diameter, comprising:

first means for positioning the plurality of cartridges wherein the longitudinal axes of the cartridges are substantially parallel with each other, said first means including means for supporting the cartridges by engaging rims of the cartridges and wherein each of the cartridges remains substantially stationary in a direction substantially parallel to the longitudinal axis of each of the cartridges during the entire time of orienting the cartridges and beginning when the cartridges are initially received by said first means and while being positioned parallel relative with each other using said means for supporting the cartridge rims;

second means operatively connected to said first means for using the force of gravity to move at least one of said positioned cartridges in a direction substantially perpendicular to the longitudinal axis thereof, said second means having an opening to permit removal of cartridges; and latch means operatively associated with said second means for preventing movement of cartridges from the apparatus, said latch means being movable in substantially a straight line to permit movement of at least one cartridge from the apparatus wherein said one cartridge has a longitudinal axis and said longitudinal axis is substantially horizontal when said one cartridge moves out of the apparatus.

9. The apparatus as claimed in claim 8, wherein:

said first means comprises means for using the force of gravity to position said plurality of cartridges.

10. The apparatus as claimed in claim 8, wherein:

said first means comprises at least two substantially parallel rails spaced apart a first distance, said first distance being greater than said body diameter and said first distance being less than said rim diameter.

11. An apparatus for orienting a plurality of unoriented rim-fire cartridges each having a longitudinal axis, a body diameter and a rim diameter, comprising:

first means for positioning the plurality of cartridges wherein the longitudinal axes of the cartridges are substantially parallel with each other;

second means operatively connected to said first means for using the force of gravity to move at least one of said positioned cartridges in a direction substantially perpendicular to the longitudinal axis thereof said second means having a opening to permit removal of cartridges;

first support means for maintaining at least a portion of said apparatus in a first substantially horizontal position while said cartridges are being positioned; and second support means for maintaining said portion of said apparatus in a second substantially vertical position while said one cartridge is moved in a direction perpendicular to its longitudinal axis.

12. An apparatus for orienting a plurality of unoriented rim-fire cartridges each having a longitudinal axis, comprising:

first means for positioning said cartridges to lie in a plurality of columns wherein the longitudinal axes of said cartridges are substantially parallel; and second means for moving said plurality of cartridges from said plurality of columns through a chute having first and second side walls and an opening while maintaining said plurality of cartridges in substantially parallel relationship.

13. The apparatus as claimed in claim 12, wherein:

said means for moving comprises:

gate means for providing communication between said chute and a first of said columns while preventing communication between said chute and at least a second of said columns while said gate means is in a first position.

14. The apparatus as claimed in claim 13, wherein:

at least one of said side walls of said chute comprises a portion which moves outward from said chute when said gate means is moved from said first position to a second position.

15. The apparatus as claimed in claim 12, further comprising:

latch means for covering said opening of said chute when said latch means is in a first position, said latch means being retractable to a second position in which said opening of said chute is uncovered.

16. The apparatus as claimed in claim 12, further comprising:

means for detachably engaging said apparatus to a means for loading cartridges into a magazine.

17. The apparatus as claimed in claim 16, wherein:

said means for loading cartridges comprises a latch engagement means, and further comprising:

latch means for covering said opening;

latch opening means responsive to said latch engagement means for uncovering said opening.

18. An apparatus for positioning rim-fire cartridges in a magazine, having an open end, comprising:

means for holding a first cartridge and a plurality of oriented subsequent cartridges in a column, each of said cartridges having a rim and said column having a longitudinal axis;

means for receiving said first rim-fire cartridge;

means for holding a cartridge magazine in a predetermined position relative to said receiving means; and cartridge moving means for moving said first rim-fire cartridge in a first direction, said cartridge moving means moving in a first direction to move said first rim-fire cartridge in said first direction towards the open end of the magazine and then moving in a second direction to move said first rim-fire cartridge in said second direction into the open end of the magazine and wherein said cartridge moving means continuously contacts said first firm-fire cartridge while moving in said first and second directions.

19. The apparatus as claimed in claim 18, wherein:

said first direction is substantially perpendicular to said longitudinal axis of said column.

20. The apparatus as claimed in claim 18, further comprising:

means for engaging the magazine to hold the magazine in a predetermined spatial relationship with said cartridge receiving means.

21. The apparatus as claimed in claim 18 further comprising:

a slot for guiding said rim of said first cartridge during said movement in said first direction.

22. An apparatus for loading a rim-fire cartridge having a longitudinal axis into a magazine having an opened end, comprising:

first means for receiving a first cartridge having a rim;

second means for moving said first cartridge to position said cartridge with said longitudinal axis in a first angular relationship with respect to said opened end; and third means for moving said cartridge in a first direction through said opened end while changing the angular relationship of said longitudinal axis to said opened end to an angular relationship different from said first angular relationship.

23. The apparatus as claimed in claim 22, further comprising:

a slot for guiding said rim of said first cartridge during said movement in said first direction.

24. The apparatus, as claimed in claim 22, further comprising:

a cam and cam follower for controlling the motion of said cartridge receiving means.

25. The apparatus as claimed in claim 24, further comprising:

a second cam follower responsive to the movement of said first cam follower.

26. The apparatus as claimed in claim 22, further comprising:

means for engaging with a cartridge orienting means to provide a column of oriented cartridges adjacent said loader apparatus.

27. In a method for orienting and loading a plurality of randomly oriented rim-fire cartridges comprising:

providing an orienter having rails;

positioning said orienter such that said rails are substantially horizontal;

placing said plurality of unoriented cartridges adjacent to said rails wherein said cartridges move such that the longitudinal axes of said cartridges are substantially parallel; and positioning said orienter such that said rails are substantially vertical.

28. A method for loading cartridges into a magazine comprising:

providing a first device for orienting cartridges substantially by the use of gravity;

placing a plurality of unoriented cartridges adjacent to said first device;

using said first device to orient said plurality of unoriented cartridges;

positioning said first device to move at least some of said plurality of cartridges to provide a substantially vertical column of substantially parallel cartridges;

positioning said first device in operative engagement with a loading device having cartridge moving means;

positioning the magazine in a predetermined spatial relationship with said loading device;

moving said cartridge moving means in a first direction to move at least a first cartridge in a first direction towards the open end of the magazine;

moving said cartridge moving means in a second direction to move the first cartridge in said second direction into the open end of the magazine; and contacting continuously the first cartridge with said cartridge moving means while moving in said first and second directions.

29. A method of loading cartridges into a magazine having an opened end, comprising:

providing an apparatus having a movable cartridge receiving means and magazine receiving portion;

placing the magazine in said magazine receiving portion such that the opened end of the magazine is adjacent said movable cartridge receiving means; and using said movable cartridge receiving means to move said plurality of cartridges one at a time through said opened end into the magazine, said step of using includes moving said movable cartridge receiving means in a first direction to move at least one of said plurality of cartridges in said first direction towards the opened end of the magazine and then moving said movable cartridge receiving means in a second direction to move the one cartridge in said second direction into the opened end of the magazine and wherein said movable cartridge receiving means continuously contacts the one cartridge while moving in said first and second directions.

30. A method for loading rim-fire cartridges into a magazine having an opened end comprising:

providing an apparatus having a movable cartridge holding means and a magazine receiving means;

positioning the magazine in said magazine receiving means such that said opened end is adjacent said movable cartridge moving means;

using said cartridge holding means to move the rim portion of a first of said cartridges through said opened end while the longitudinal axis of said cartridge is in a first angular relationship with said opened end; and moving said cartridge through said opened end into the magazine while changing the angular relationship of said longitudinal axis with said opened end to a second angular relationship different from said first angular relationship.

31. An apparatus for positioning rim-fire cartridges in a magazine comprising:

means for holding a first cartridge and a plurality of oriented subsequent cartridges in a column, each of said cartridges having a rim and said column having a longitudinal axis;

means for receiving said first rim-fire cartridge;

means for holding a cartridge magazine in a predetermined position relative to said receiving means;

means for moving said first rim-fire cartridge in a first direction while preventing movement of said subsequent cartridges in said first direction; and a cam and cam follower for controlling the motion of said cartridge receiving means.

32. The apparatus as claimed in claim 31, further comprising:

a second cam follower responsive to the movement of said first cam follower.

33. An apparatus for positioning rim-fire cartridges in a magazine comprising:

means for holding a first cartridge and a plurality of oriented subsequent cartridges in a column, each of said cartridges having a rim and said column having a longitudinal axis;

means for receiving said first rim-fire cartridge;

means for holding a cartridge magazine in a predetermined position relative to said receiving means;

means for moving said first rim-fire cartridge in a first direction while preventing movement of said subsequent cartridges in said first direction;

a cam and cam follower for controlling the motion of said cartridge receiving means; and means for engaging with a cartridge orienting means to provide a column of oriented cartridges adjacent said loader apparatus.

* * * * *